United States Patent [19]

Gerace

[11] Patent Number: 4,838,213

[45] Date of Patent: Jun. 13, 1989

[54] THERMAL IGNITION METHOD AND APPARATUS FOR INTERNAL COMBUSTION ENGINES

[76] Inventor: Anthony Gerace, 28 Allegheny Ave., #2601, Towson, Md. 21204

[21] Appl. No.: 229,507

[22] Filed: Aug. 8, 1988

[51] Int. Cl.[4] ..... F02B 75/00

[52] U.S. Cl. ..... 123/27 R; 123/286; 123/288; 123/25 C

[58] Field of Search ..... 123/25 C, 286, 288, 123/290, 27 R

[56] References Cited

U.S. PATENT DOCUMENTS

| | | | |
|---|---|---|---|
| 974,853 | 11/1910 | Bock | 123/255 |
| 1,302,653 | 5/1919 | Goodspeed | 123/27 R |
| 2,552,657 | 5/1951 | Ziegler | 123/278 |
| 3,077,868 | 2/1963 | Georges | 123/280 |
| 3,580,231 | 5/1968 | Bradbury | 123/277 |
| 4,075,996 | 2/1978 | Hisserich | 123/143 A |
| 4,162,664 | 7/1979 | Fleming | 123/288 |
| 4,289,097 | 9/1981 | Ward | 123/292 |
| 4,635,590 | 1/1987 | Gerace | 123/27 R |

*Primary Examiner*—E. Rollins Cross

*Attorney, Agent, or Firm*—Cushman, Darby & Cushman

[57] ABSTRACT

The compression stroke supplies a small portion of the compressed air to a considerably smaller, fixed-volume receiving chamber through a valved communication passage. Simultaneously, fuel is injected into the air stream to mix with the air with the air pressure increasing in the small chamber until the air reaches ignition temperature to ignite the air/fuel mixture. The resulting rapid rise in pressure acts upon a check valve to seal the passage and to contain the combustion process within the small chamber. The small quantity of air therein is insufficient to support complete combustion, therefore most of the fuel is conditioned to a state of auto-ignition. The piston continues to compress the main air charge in the cylinder and slightly before TDC a controllable valve opens a second passage to expel the superheated mixture into the large volume of compressed air in the cylinder. The fuel is instantaneously oxidized, creating a high pressure gas to apply force to a piston that connects to working elements that connect to work. This combustion method extracts the maximum energy from various types and grades of liquid, gaseous or particulate fuels without electrical ignition systems or high pressure fuel injection systems. Additional energy would be extracted by converting the heat energy to a steam power cycle, which also cools the engine internally.

10 Claims, 4 Drawing Sheets

THERMAL IGNITION METHOD AND APPARATUS FOR INTERNAL COMBUSTION ENGINES

BACKGROUND OF THE INVENTION

The present invention relates to internal combustion engines and, more particularly, to method and apparatus for operating internal combustion engines in a thermally efficient manner.

The predominant internal combustion engine configuration in present use is the crankshaft/cylinder arrangement with a working piston reciprocating within a cylinder and connected to a rotatable crankshaft. The piston reciprocates within its cylinder in accordance with one of two predominant operating cycles, namely, the two- or four-stroke spark-ignition Otto cycle or the two- or four-stroke compression-ignition Diesel cycle. With the spark-ignition cycle, a homogeneous mixture of air and fuel at a preferred air/fuel ratio is compressed with ignition caused by an electrical spark or the equivalent. In the compression-ignition cycle, fuel is injected into air that has been compressed to cause an adiabatic increase in its temperature to a temperature above the auto- or self-ignition temperature of the fuel.

Both types of operating cycles and the various physical engine configurations that have been developed have proved satisfactory although each has attendant drawbacks. In the spark-ignition engine, the fuel must be pre-mixed with air to provide a desirably homogeneous mixture with the ratio of the air to the fuel controlled so as to fall within a preferred ratio range, e.g., between 11:1 and 17:1. Air/fuel ratios greater than 17:1 result in mixtures which may or may not combust and air/fuel ratios below 11:1 result in mixtures which are inefficient from the standpoint of fuel consumption and unacceptable with regard to air pollution. Additionally, the compression ratio of the spark-ignition engine is limited to some maximum so as not to cause unintentional pre-ignition of the homogeneous air/fuel mixture during the compression stroke. The compression ratio limit also disadvantageously limits the thermal efficiency of spark-ignition engines.

In contrast to the spark-ignition engine, the compression-ignition engine utilizes air that has been heated during the compression stroke to a temperature greater than the auto-ignition temperature of the fuel so that fuel can be injected in a heterogeneous manner into the so-heated air to cause burning. Thus, the fuel injected in a compression-ignition engine can be burned in considerable excess air to provide a comparatively large mass of heated air for the expansion stroke. Accordingly, the compression-ignition engine provides a substantial increase in thermal efficiency compared to the spark-ignition engine. Unfortunately, compression-ignition engines require a rather sophisticated and expensive fuel delivery and injection system that mitigates against the increase in thermal efficiency.

A third combustion cycle, the Gerace cycle as disclosed in applicant's U.S. Pat. Nos. 4,520,765 and 4,635,590, achieves a synthesis of the Otto and Diesel cycles by providing a piston/cylinder chamber that serves as a low pressure air-fuel chamber and a second piston/cylinder chamber that serves as a high pressure, high temperature ignition-air chamber. A valve separates the two chambers and is opened and closed through the cycle to effect operation. Prior to the compression cycle, the valve is closed and an air-fuel mixture is compressed to a selected compression ratio less than that which would cause pre-ignition. Concurrently, the air in the ignition-air chamber is compressed to a selected compression ratio that is sufficient to raise the temperature substantially above the ignition temperature of the air-fuel mixture in the air-fuel chamber. Ignition is achieved by opening the valve to permit the high pressure, ignition temperature air to discharge into the air-fuel cylinder. The ignition air is quickly vented into the heated air-fuel mixture, creating turbulent combustion, and mass ignition of the fuel. The rapidly increasing pressure from the burning air-fuel mixture in the air-fuel chamber is transferred through the still open valve to the ignition-air chamber which provides additional oxygen to completely oxidize any unburned fuel. As a consequence, the homogeneous air-fuel charge is burned under excess air conditions in which a relatively large mass of heated gas and combustion products operates against the working pistons. The net result is the complete burning of the fuel at the very beginning of the expansion cycle providing high pressure gas for the expansion process.

SUMMARY OF THE INVENTION

In view of the above, it is the primary object of the present invention, among others, to provide an improved cycle for internal combustion engines in which air and various types and grades of fuel in a mixture are ignited by thermal ignition techniques at compression ratios as high as practical limitations allow.

It is also an object of the present invention to provide an engine having an operating cycle that provides improved thermal efficiency in which the physical, ignition, and chemical delay periods are considerably reduced and in which combustion occurs under constant volume and/or constant pressure conditions and in which very high compression and expansion ratios are utilized.

It is also an object of the present invention to provide an engine that will eliminate expensive fuel delivery systems by mixing air and fuel in a low pressure chamber prior to introduction into the primary working chamber and which will provide an engine that will operate at the ideal air/fuel ratio for maximum power or a very lean air/fuel ratio (50:1 or more) to provide for high thermal and air standard efficiencies.

It is also an object of the present invention to provide an engine without an electrical ignition system and provide a system to cause combustion of the fuel automatically, without outside or remote control systems, and wherein the input of fuel solely governs the engine power output.

It is also an object of the present invention to provide an engine that will convert the heat within the engine to steam to extract additional energy and thereby reduce or eliminate the engine cooling system.

It is also an object of the present invention to provide apparatus for converting Otto or Diesel cycle engines to the inventive operating cycle by simply removing and substituting thermal ignition injectors in accordance with the present invention for conventional spark plugs and injectors.

In accordance with the above objects, and others, the present invention provides for the thermal ignition of a mixture of air and fuel in a low-pressure secondary chamber prior to introduction into the primary working chamber to thereby dispense with the high pressure fuel injection arrangements utilized on compression-ignition engines and the fuel introduction system used in direct-injected spark-ignition engines. In addition, the system of the present invention provides for the burning of the fuel under excess air conditions and for the rapid heating of a relatively large mass of air to provide a comparatively large expansion ratio that affords an opportunity to extract the maximum working energy from the gaseous combustion products and thereby optimize overall thermal efficiency.

A thermal ignition cycle is provided for an internal combustion engine having at least one variable-volume working chamber defined by a piston and cylinder combination that selectively communicates with an air-fuel receiving chamber. During operation of the cycle, the working piston compresses an initial air charge in the working chamber to effect a temperature and pressure increase. The heated and pressurized air is also communicated to the air-fuel receiving chamber into which fuel is concurrently introduced to produce a homogeneous air-fuel mixture. The communication between the air-fuel receiving chamber and the working chamber is interrupted prior to the temperature of the air-fuel mixture in the air-fuel receiving chamber attaining ignition. The compression is continued until the temperature of the heated air in the working chamber attains or exceeds the ignition temperature of the air-fuel mixture in the air-fuel receiving chamber, at which time a transfer valve is opened to admit ignition-temperature air into the air-fuel receiving chamber to cause ignition therein with the increase in pressure in the air-fuel receiving chamber consequent to ignition driving the air-fuel mixture into the working chamber where combustion occurs under excess air conditions to heat a large mass of air for expansion against the working piston.

Other objects and further scope of applicability of the present invention will become apparent from the detailed descriptions to follow, taken in conjunction with the accompanying drawings, in which like parts are designated by like reference characters.

DESCRIPTION OF THE PREFERRED EMBODIMENT

Figure 1:
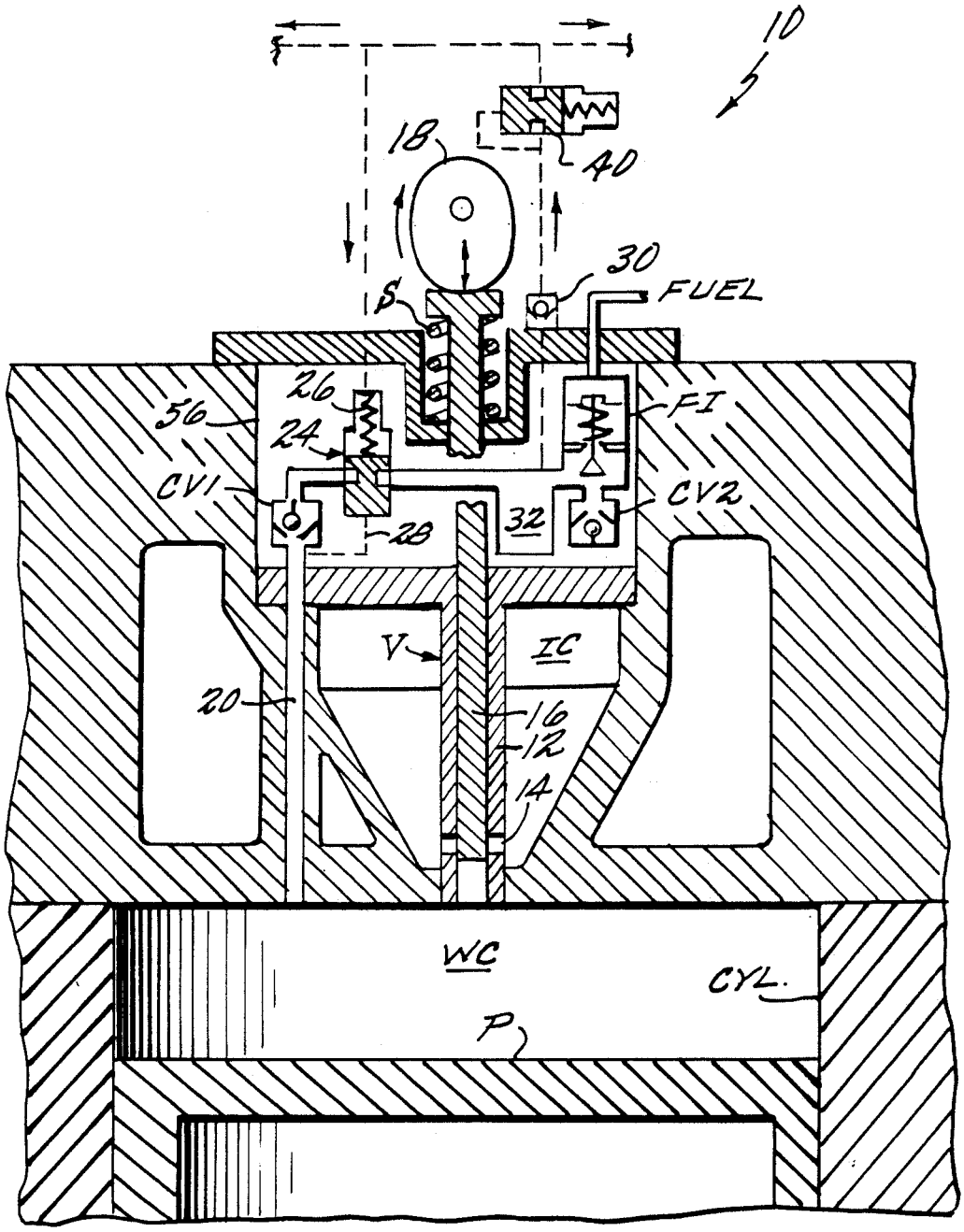
FIG. 1 is an elevation view, in cross section, illustrating a first preferred embodiment of the present invention.

An exemplary embodiment of the present invention in the context of a two-stroke or four-stroke engine is shown in FIG. 1 and designated therein by the reference character 10. The thermal ignition system 10 includes a air-fuel ignition chamber IC into which an air-fuel mixture is introduced prior to its introduction into the working chamber WC through a transfer valve V which includes a hollow sleeve 12 that opens into the working chamber WC and which includes one or more ports 14 at its lower end extending between and providing communication between the air-fuel ignition chamber IC and the working chamber WC. A valve member 16 is reciprocally mounted within the sleeve 12 for controlled motion between a lower position in which the lower end of the valve member 16 blocks communication between the air-fuel ignition chamber IC and the working chamber WC, as shown in FIG. 1, and an upper position (not shown) in which fluid communication is established between the air-fuel ignition chamber IC and the working chamber WC. The valve member 16 is normally biased toward its upper, open position by a valve spring S bearing against the upper, headed end (unnumbered) and cyclically driven between its two positions by an actuator which may take the form of a rotatably mounted cam 18, for example, as shown in FIG. 1. As the cam 18 rotates about its axis, the valve 16 is reciprocated to periodically uncover the ports 14 and effect communication between the working chamber WC and the air-fuel ignition chamber IC and cover the ports 14 to interrupt communications. The components of the transfer valve V can be fabricated from those materials typically used to fabricate exhaust valve and exhaust valve seats including various alloyed steels, sintered materials, and ceramic matrixes.

The thermal ignition system 10 includes a fluid controller 56, shown in schematic form in FIG. 1, which includes an air passage 20 extending from the working chamber WC to provide compressed air to a check valve CV1, which, in turn, leads to a pressure regulator 24 that regulates the pressure of the compressed air via a regulator spring 26. The pressure regulator 24 includes a pilot control line 28 (dotted line illustration) extending between the inlet air passage 20 and the pressure regulator 24 that forces the pressure regulator 24 closed in response to a selected upper pressure limit in the inlet air passage 20. The pressure regulated air is provided to an accumulator plenum 32 and through a second check valve CV2 into the air-fuel ignition chamber IC. A fuel injector FI, shown in schematic form, accepts fuel in liquid or gaseous form from an inlet line 'FUEL' and is selectively controlled to inject the fuel into the pressurized air in the immediate area of the check valve CV2.

The thermal ignition cycle begins with the piston P at or near its bottom position with combustion air introduced into the working chamber WC through the appropriate inlet or valve ports (not shown). The transfer valve V is closed by the cam 18 at or near the beginning of the compression stroke as the piston P is moved from its bottom dead center position toward its top dead center position. As the air is compressed during the compression stroke, a small portion of the compressed air is supplied to the air-fuel ignition chamber IC through the air passage 20, the check valve CV1, the pressure regulator 24, which is held in the open position by the spring 26, and through the check valve CV2. The pressure regulator 24 serves to control the pressure of the air introduced into the air-fuel ignition chamber IC as explained below. As the pressure-regulated compressed air is introduced into the air-fuel ignition chamber IC, the fuel injector FI injects fuel into the air stream to provide an air-fuel mixture in the air-fuel ignition chamber IC.

The pressure regulator 24 is adjusted to provide pressurized air in the passages leading to and in the air-fuel ignition chamber IC at a pressure sufficiently high so that the temperature of the air entering the air-fuel ignition chamber IC is above the ignition temperatures of the fuel for a wide range of operating conditions. As an example, for a given fuel that would ignite at 160 psi in a cold engine during cold weather conditions and at 70 psi for a hot engine during warm weather operation, the pressure regulator 24 is set to close the air passage 20 at 180 psi as the system upper limit. If desired, a spark igniter, glow plug, or hot-wire can be used to assist in starting ignition. As can be appreciated, the fuel passing through the check valve CV2 into the air-fuel ignition chamber IC ignites with the rapid increase in pressure closing the check valve CV2. As the piston P continues its compression stroke, the accumulator plenum 32 is charged with compressed air at the upper cut-off pressure of the pressure regulator 24, at which time, the pressure in pilot line 28 overcomes the force of the spring 26 to close the pressure regulator 24. The compressed air stored in the plenum 32, as explained below, will assist in scavenging the air-fuel ignition chamber IC.

At or adjacent the end of the compression stroke, the cam 18 opens the transfer valve V to discharge the auto-ignited fuel through the ports 14 into the large volume of air in the working chamber WC to complete the combustion process with the fuel continuing to burn under excess air conditions. The expansion stroke then follows as the piston P retracts in response to the substantial gas pressures developed during combustion towards its bottom dead-center position. As the pressure is reduced by expansion to a point below the pressure of the air stored within the accumulator plenum 32, the check valve CVI closes and the check valve CV2 opens to permit the compressed air momentarily stored in the accumulator plenum 32 to scavenge the ignition chamber IC and force any remaining combustion products in the air-fuel ignition chamber IC through the open transfer valve V into the working chamber WC. The volume of the accumulator plenum 32 provides compressed air to scavenge and displace the total volume of the ignition chamber IC.

As the piston P attains its bottom dead center position, the exhaust ports (not shown) are uncovered and the exhaust gases discharged. Concurrently with the exhausting or removal of the combustion products, combustion air is introduced into the working chamber WC through the inlet ports (not shown) and the process repeated.

As an optional feature, a control check valve 30 and control regulator 40 provides a means of varying the pressure setting of pressure regulator 24. The adjustment spring 26, in this case, is set to provide a minimum limit of, e.g., 60 psi, for the air-fuel ignition chamber IC. The pressure is additionally regulated from the control regulator 40 from 0 to 120 psi to vary the pressure setting of pressure regulator 24 from 60 to 180 psi. Varying the pressure in air-fuel ignition chamber IC will provide more or less heat to the fuel and allow more precise control of the combustion process.

It could be advantageous under certain operating conditions to delay the start of ignition and extend the combustion process to a later period so that nearly constant pressure conditions are maintained in a manner analogous to that of the Diesel cycle. A delayed start is accomplished by reducing the pressure in the air-fuel ignition chamber IC to reduce the temperature of the air within to a temperature below the ignition temperature of the fuel. In this manner, the air-fuel mixture within the air-fuel ignition chamber IC is pre-heated but below its auto-ignition temperature. As the piston P attains a position in advance of or at top dead center and the combustion air within the working chamber WC attains a temperature above the ignition temperature of the air-fuel mixture on the opposite side of the transfer valve V, the transfer valve V is opened to allow the higher pressure, higher temperature combustion air in the working chamber WC to pass through the open ports of the transfer valve V into the air-fuel ignition chamber IC to start ignition in a manner analogous to that of applicant's above-mentioned U.S. Pat. Nos. 4,520,765 and 4,635,590. The inrush of the high pressure air from the working chamber WC into the air-fuel ignition chamber IC results in a violent turbulence within the air-fuel ignition chamber IC and the commingling of this additional, higher temperature air with the air-fuel mixture. The ignition temperature air causes a portion of the fuel to ignite and the rapid increase in temperature results in superheating of the unburned portion of the fuel to greatly increase the pressure within the relatively small volume of the air-fuel ignition chamber IC. The combustion air at auto-ignition temperature and the fuel discharging into the considerably larger volume of the working chamber WC causes instantaneous combustion of the first portion of the fuel that enters. The resulting turbulence quickly intermixed the remaining fuel with combustion air to complete the combustion process.

By varying the heat addition to the fuel by simply varying the pressure in the ignition chamber IC, it is possible to alter the combustion process to start ignition within the ignition chamber IC to assure instantaneous cold weather engine starting and the attainment of higher engine speeds and efficiencies than possible with the Otto or Diesel cycles.

Figure 2:
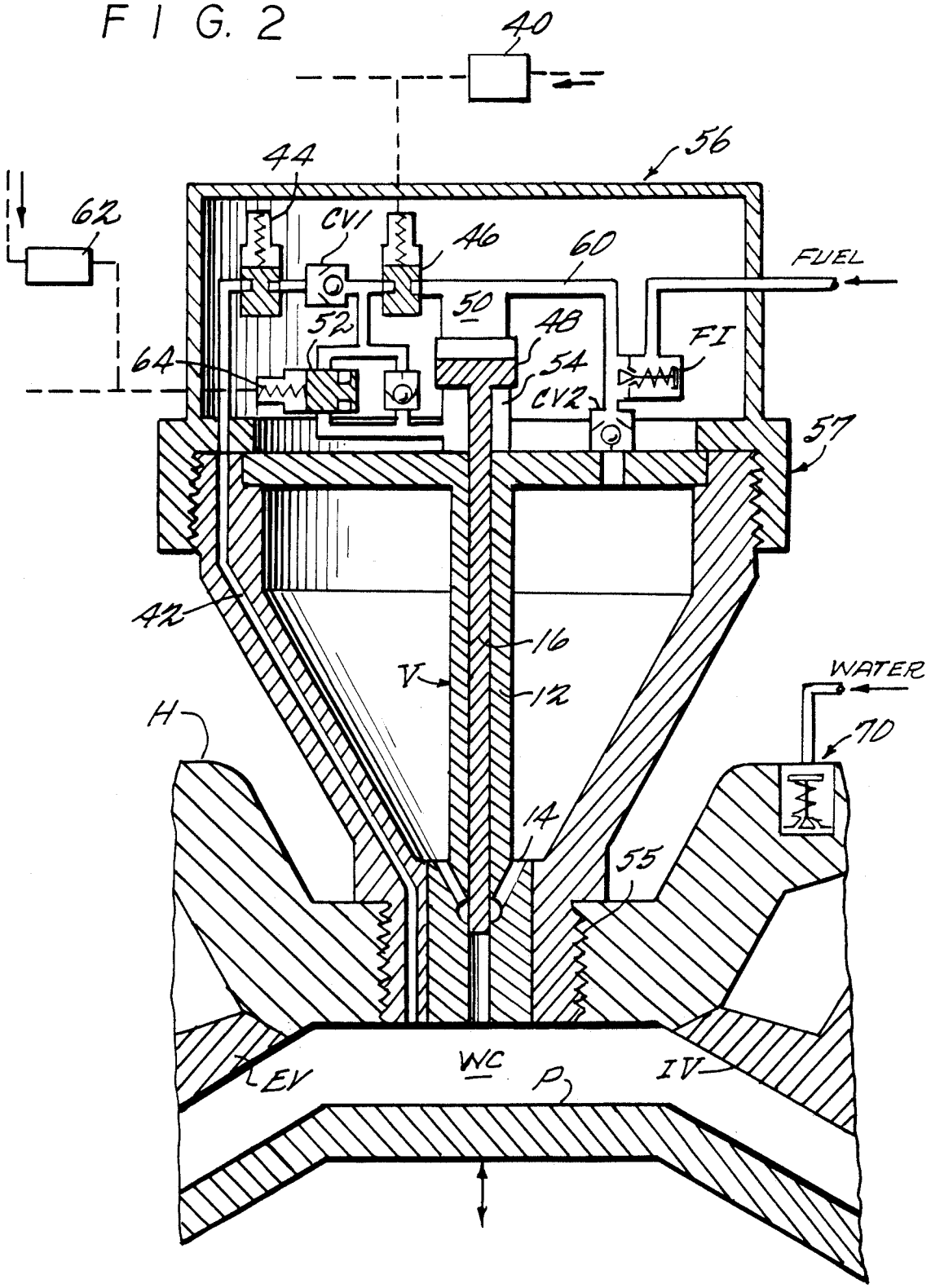
FIG. 2 is a schematic diagram illustrating a second embodiment of the present invention.

FIG. 2 represents a single working chamber WC in a two- or four-stroke cycle in an engine block (not shown in FIG. 2) having a cylinder in which a working piston P (partially shown) reciprocates between top dead and bottom dead center positions as indicated generally by the bi-directional arrow. The piston P is connected, for example, by a connecting rod to a crankshaft (not shown) to convert the reciprocating motion of the piston P into rotary motion as is conventional in the art. A head H is mounted atop the engine block in the conventional manner to define a closed working chamber WC between the top of the piston P and the walls of the cylinder (not specifically shown in FIG. 2) and in which fuel is combusted to effect heating of the gases in the working chamber WC and expansion thereof against the face of the piston P. In contrast to the embodiment of FIG. 1, inlet and exhaust valves IV and EV (only partially shown) are provided in the head H at the upper end of the cylinder for introducing combustion air into the working chamber WC and exhausting combustion products therefrom. The compression ratio provided by the piston P and the cylinder for the piston stroke is sufficiently high to insure heating of the compressed air to a temperature above the ignition temperature of the fuel used.

A thermal ignition system in accordance with the present invention is provided as a screw-in adapter in the head H for introducing the air-fuel mixture into the working chamber WC. As shown in FIG. 2, a thermal ignition injector 57 includes a control section 56 that automatically controls the thermal ignition cycle with no requirements for outside or remote sensors, compensating controls, or power. As shown, the lower end of the ignition injector 57 is configured to adapt to engines with threaded openings 55 for spark plugs or diesel injectors.

The working chamber WC is charged with inlet air by the methods associated with two- or four- stroke engines. When the piston P begins its compression stroke, a small portion of the pressurized air is supplied to the ignition chamber IC through air passage 42, a connected pressure regulator 44, an air passage 60, a check valve CVI, a pressure regulator 46 and a check valve CV2. A transfer valve V is provided along the central axis of the ignition injector 57 and includes a valve member 16 mounted for reciprocation in a hollow sleeve 12 having ports 14 at its lower end that extend between the working chamber WC and the ignition chamber IC. An enlarged piston 48 is provided at the upper end of the valve member 16 and is carried in a appropriate bore (unnumbered) which defines volumes 50 and 54 on opposite sides of the piston 48. The valve member 16 is mounted for reciprocating movement between an upper position at which the ports 14 are uncovered to established communication between the ignition chamber IC and the working chamber WC and a lower position, as shown in FIG. 2, in which the ports 14 are blocked. The valve member 16 is driven, as explained more fully below, by the pressure differential present between the volumes 50 and 54 on opposite sides of the piston 48.

When the pressure in the air passage 42 increases to, e.g. 5 to 10 psi, during the compression stroke, the valve piston 48 is forced downward to close a transfer valve V. The ignition chamber IC continues to receive its air charge through the pressure regulator 44, the check valve CVI, the pressure regulator 46, the air passage 60, and the open check valve CV2 while the fuel injector FI accepts fuel from the inlet line 'FUEL' and injects the fuel into the moving air stream with all of the fuel for that cycle added before ignition. The temperature of the air in the ignition chamber, at e.g. 120 psi, ignites the fuel and the rapidly increasing pressure in the ignition chamber IC closes the check valve CV2. While the fuel is burning in the ignition chamber IC, the pressure in volume 50 continues to rise until the pressure regulator 46 closes, e.g. 180 psi. When the pressure reaches, e.g., 480 psi, a sequence valve 52 opens to pressurize the volume 54 and to force the valve piston 48 and the valve member 16 upward against the 180 psi air in the volume 50 to open the transfer valve V. The burning fuel in the ignition chamber IC is then discharged through the open ports 14 into the large mass of ignition-temperature air in the working chamber WC to complete the combustion process. The pressure regulator 44 is set to close at, e.g., 500 psi, to limit the ultimate control system pressure in the control section 56 of the ignition injector 57.

The rapid expansion of the gases in the working chamber WC as a result of the combustion therein drives the piston P downwardly during the following power stroke, and, as the moving piston P expands the volume of the working chamber WC, the pressure decreases. As the pressure is reduced to 500 psi or so, the pressure regulator 44 opens to expel the air between it and the check valve CV1, which then closes at 480 psi to store pressurized air between the check valve CVI and the pressure regulator 46. As the pressure is further reduced to 180 psi or so, the pressure regulator 46 opens, the sequence valve 52 closes, and a check valve 58 opens. The compressed air stored in air chamber 54 and its related passages is then discharged through the pressure regulator 46, the air passage 60, and the check valve CV2 to scavenge the contents of the ignition chamber IC into the working chamber WC through the still open transfer valve V. As the pressure drop continues, the air stored in the volume 50 joins the scavenging process which ends at or near atmospheric pressure. The transfer valve V remains open during the subsequent exhaust and air induction strokes, after which the complete cycle repeats as described above.

The control system described above for FIG. 2 allows each cylinder to control its combustion process independent of all of the other cylinders in the engine regardless of load or operating conditions and to automatically adapt each cylinder to maintain its combustion process at the highest efficiency level without the need for an overall control systems. As an option, the pressure regulator 46 can be controlled by a control regulator 40 to operate in the same manner as previously described for pressure regulator 24 in FIG. 1. As a second optional feature, a control regulator 62 can be provided to vary the timing of the opening of the transfer valve V to accomplish variable ignition timing. A spring 64 is used to set a minimum limit of, e.g., 300 psi, and regulating the pressure from the control regulator 62 from, e.g., 0 to 180 psi, to vary the pressure setting of the sequence valve 52 from 300 to 480 psi. The lower pressure opens the transfer valve V shortly before the piston P attains the TDC position to accomplish constant volume combustion at an intermediate pressure for a combination of constant volume/constant pressure combustion. At a maximum pressure, the transfer valve V opens as close as possible to the TDC position for a measure of constant pressure combustion. Experience has indicated that a wide range of adjustments is not required and that combustion is instantaneous and complete within a minimum of degrees of crankshaft rotation at all speeds to allow combustion to occur as close to TDC as possible, requiring less work from the compression stroke and completing the combustion process as close to TDC as possible to provide more work for the power stroke.

Either or both of the above options can be employed to compresses the inlet air to very high compression ratios while simultaneously using a portion of the same compressed air to provide variable heat addition to the fuel in a separate chamber and with variable timing of the ignition of the fuel to create variable combustion cycles that duplicate the Otto, Diesel, or dual cycles (constant volume and/or constant pressure combustion ) on demand. Additionally, the combustion cycle can be optimized for multiple fuels to compensate for various types and grades of fuels and operating conditions.

In the conventional compression-ignition engine, the fuel is injected under considerable pressure into the cylinder as discrete droplets of varying sizes and traveling in diverse directions throughout the combustion chamber resulting in a physical delay and an ignition delay period during which the various droplets undergo partial vaporization to be surrounded by a zone of fuel vapor, the temperature of which then rises to that of the surrounding ignition temperature air. When the initial fuel vapors begin to burn, a chemical delay takes place, during which delay the fuel vapor is consumed and during which the heat of combustion causes further vaporization of the remaining fuel droplets. As can be appreciated, some of the fuel begins burning while other of the fuel droplets still undergo fuel vaporization. As a result, the physical, ignition, and chemical delay periods of conventional compression ignition engines can be quite extensive and not at all predictable. Conversely, in the spark-ignition engine, the ignition and chemical delay is less than that of the conventional compression ignition engines and the physical delay is substantially eliminated since the air/fuel mixture is in a homogeneous state just prior to ignition. However, ignition occurs at a point source and spreads through the combustion chamber as an expanding wave front that is a function of the turbulence velocity before ignition occurs. In contrast to both the compression-ignition and spark-ignition engines, the physical, ignition, and chemical delay of the present invention is considerably reduced since the air/fuel mixture is in a state of auto-ignition just prior to combustion and combustion occurs spontaneously as it contacts and intermixes with the ignition temperature air in the working chamber WC. The resulting violent turbulence accelerates the burning wave front through the highly compressed air mass to the face of the piston P and the walls of the cylinder to cause a layered or stratified combustion.

Since most of the heat released via combustion occurs at the very beginning of the expansion cycle, the temperature differences between the beginning and the end of the expansion stroke will be relatively larger and, as a result, an extension in efficiency is obtained over the efficiency of the Diesel cycle. This extended temperature difference continually widens as the mixtures become progressively leaner as the weight of the fuel is reduced for a given weight of air or with increasingly larger amounts of air for a given amount of fuel. Additionally, the present invention provides for a wide range of air-fuel ratios. A very rich mixture in the ignition chamber IC combined with a given weight of air in the working chamber WC results in overall air-fuel ratios suitable for high load conditions or very high efficiencies with air-fuel ratios extended to 50:1 or more. Except for rich mixture requirements, the air-fuel ratios for transportation systems under most operating conditions could be in the range 20 to 40:1 or more. The volumetric efficiency would also be high with an unrestricted air induction system for many applications. The air intake could be throttled at times to reduce the amount of air supplied to decrease the rate of compression, providing less work for the starting system. The smaller quantity of air would also absorb less heat during the warm-up period, allowing the engine to attain operating temperature quickly. During the operation of the Otto or Diesel engine, a layer of fuel adheres to the chilled cylinder walls and the fuel may lose heat so rapidly as to escape combustion. The thickness of this layer has a distinct influence upon the power output and the efficiency of the engine. The present invention overcomes this particular problem by delivering the fuel to a small ignition chamber with a surface area many times less than the usual combustion chamber. The pre-ignited and superheated fuel in the ignition chamber, when discharged into the large mass of ignition temperature air in the working chamber WC results in spontaneous and complete combustion of the fuel before it reaches the cylinder walls.

Except for cogeneration engine systems, the heat loss in most engines represents approximately 75% of the fuel energy due to the cooling system, the exhaust system, and engine radiation, dissipating the heat into the atmosphere, creating a thermal cycle that is irreversible. A reversible thermal cycle and higher efficiencies are possible with this new cycle because its unique operating conditions provides a means for combustion and steam cycles.

The addition of a third option provides for a steam cycle during every power mode. During the intake cycle water injector 70 injects water so that an air-water mixture is layered at the lower end of the cylinder and air only at the upper end. During compression the fuel is pre-ignited as described above and, near the end of the compression, the burning fuel is discharged into the layer of air in the working chamber WC to cause combustion of the fuel. The resulting release of the heat energy is absorbed by the air-water mixture which coverts to steam at some point during the expansion mode. The weight of water required during this conversion is many times greater than the weight of the fuel. It may also be desirable to elevate the water temperature, using exhaust heat, before the water is injected into the air intake system.

Figure 3:
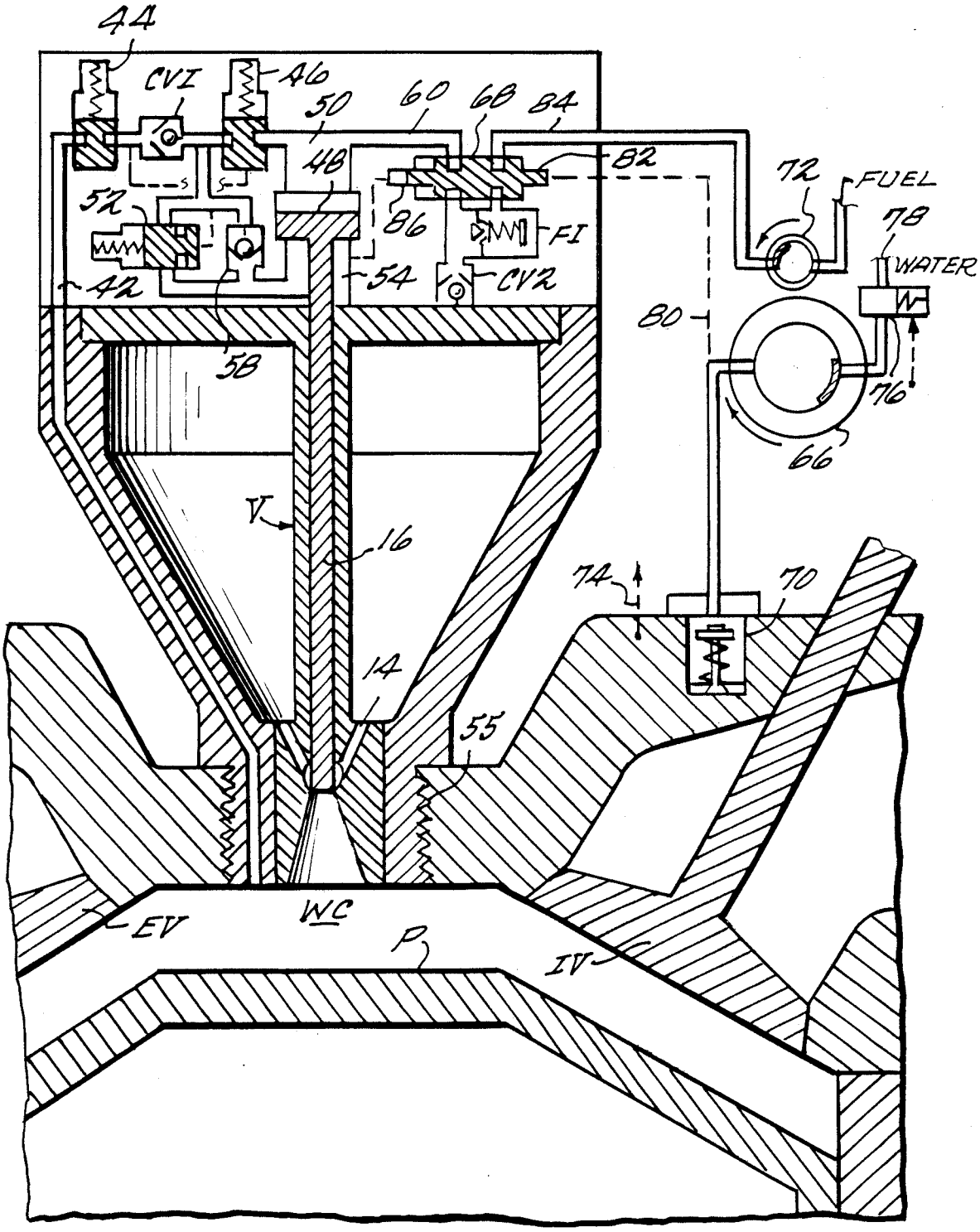
FIG. 3 is a schematic diagram illustrating a third embodiment of the present invention.

FIG. 3 illustrates a modification of the structure of FIG. 2 with the additional components required to accomplish an alternate combustion and steam cycle including a water distributor 66, a dual passage pilot operated valve 68, and a water injector 70 mounted upstream from the inlet valve IV port. The sequence of operations begins by starting a cold engine and running it until it reaches operating temperature in a manner consistent with that described above. During this period, fuel is supplied by a fuel distributor 72 to the fuel injector FI at the beginning of every compression cycle with the events within the thermal ignition injector occurring as described above for FIG. 2. At operating temperature, a thermocouple 74 mounted in the cylinder head H signals a solenoid operated valve 76 to open a water inlet line 78 and start the flow of water into the water distributor 66. The fuel distributor 72 powers the water distributor 66 through a 2:1 ratio drive (represented in schematic form) which provides water delivery to the water injector 70 at the beginning of every other intake cycle. As the water injector 70 injects a water mist into the intake air stream, a water pilot line 80 (dotted-line illustration) is charged and applies water pressure to a water pilot 82. This pressure shifts the pilot-operated valve 68 to the closed position to seal or close the fuel line 84 and the air passage 60.

During the beginning of the compression cycle, the air passage 42 supplies pressurized air to the volume 50 above the valve piston 48, forcing it downward to close the transfer valve V. The fuel from the fuel distributor 72 is blocked by the closed pilot-operated valve 68 which also closed the air passage 60 to maintain as low a pressure as possible within the ignition chamber IC. While the compression cycle proceeds, the heat generated by the previous combustion cycle is quenched and absorbed by the water mist before escaping the cylinder environment. Near the end of the compression cycle, the sequence valve 52 opens to apply air pressure to the volume 54 on the underside of valve piston 48 to open the transfer valve V and to reset the pilot 86 to reset the pilot-operated valve 68 for the following combustion cycle. A portion of the high pressure air-water mixture discharges into the ignition chamber IC and the resulting reduction in pressure converts the superheated water mist into steam to provide steam power to the piston P. During this mode, the air-water mixture cools the intake valves IV and the discharge of the steam from the working chamber WC cools the exhaust valves EV.

Experimentation with the amount of water injected and/or more than one water cycle between the combustion cycles indicates the possible elimination of conventional cooling systems. In effect, the engine would be cooled from the inside and would considerably reduce heat radiation from the engine. The thermal ignition cycle combined with the steam cycle provides a multi-fuel, adiabatic engine with a thermal cycle that provides for maximum transformation of heat into work.

Figure 4:
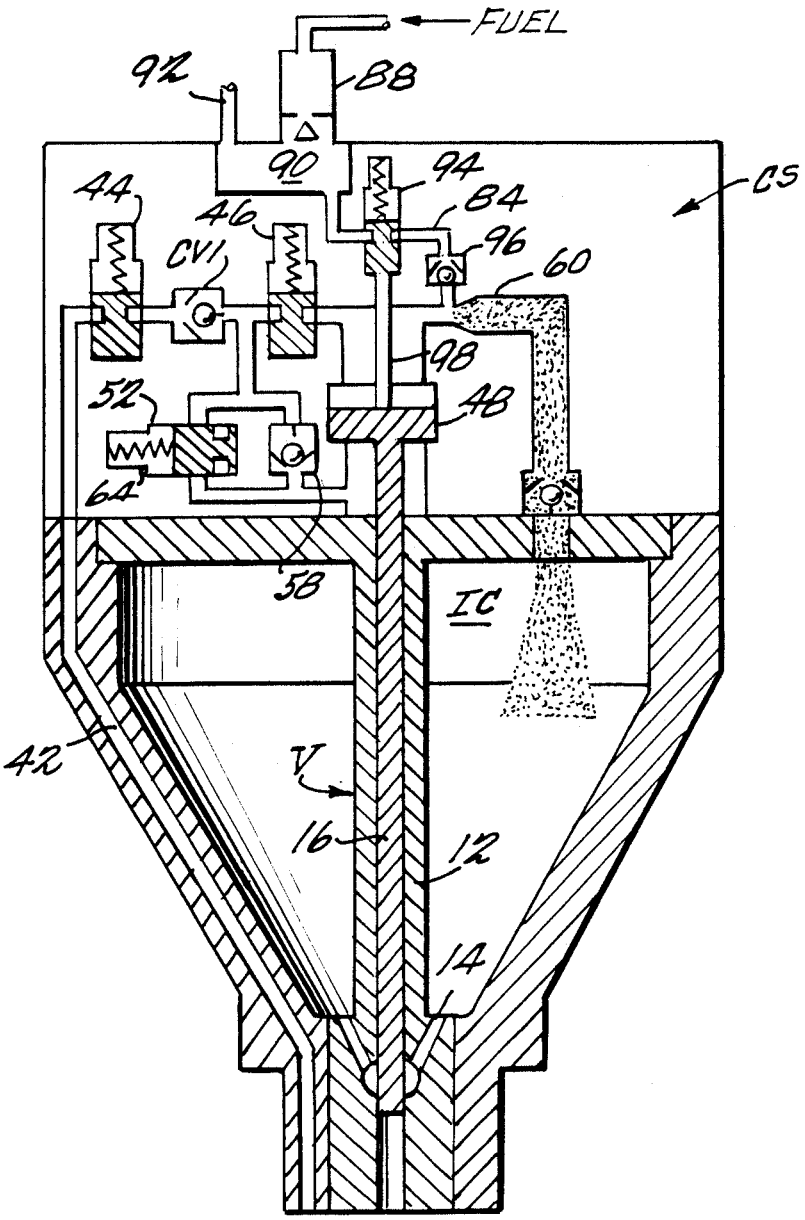
FIG. 4 is a schematic diagram illustrating a fourth embodiment of the present invention.

In FIG. 4, the components to the left of the valve piston 48 function in the same manner as described for FIG. 2. The additional components included in the control section CS facilitate and simplify the adaption of the thermal ignition injector to existing engines. The added components include a fuel valve 88, a fuel chamber 90 with an atmosphere vent 92, a fuel flow valve 94, and a fuel check valve 96, all of which provide control of the fuel delivery. The fuel can be delivered to the fuel chamber 90 at any time before or after the compression stroke through the fuel valve 88. Near the beginning of the compression stroke, the air passage 42 supplies pressurized air to force the valve piston 48 downward to close the transfer valve V. The fuel flow valve 94 opens via a connecting rod 98 with the valve piston 48, an arrangement that also eliminates the possibility of untimely fuel delivery. The air flowing through the air passage 60 creates a vacuum in the fuel line 84 which draws the fuel and aspirates it before entering the ignition chamber IC. When the air is no longer flowing in the air passage 60, the resulting pressure rise closes the fuel check valve 96. Atmospheric pressure is maintained in the fuel chamber 90 by the atmosphere vent 92. At a predetermined pressure setting, the sequence valve 52 opens before the end of the compression stroke to apply the force of the higher pressure air to the underside of the valve piston 48 to close the fuel flow valve 94 and open the transfer valve V to complete the combustion process.

The configuration of FIG. 4 permits the removal of spark plugs or fuel injectors from their openings in conventional engines and the installation of the thermal ignition injectors of the present invention into existing Otto and Diesel cycle engines, including the Wankle engine.

The present invention also solves the inherent drawbacks of present day engines that operate by the two stroke cycle. In the Otto two stroke cycle, the air and fuel are pre-mixed and when the cylinder is charged with this mixture, the engine is in the process of discharging the spent products of combustion through the exhaust port. If the exhaust port closes too early, a portion of the exhaust products remain within the cylinder, diluting the new mixture, and, if it closes too late, raw fuel is expelled into the atmosphere and efficiency suffers. The much slower Diesel engine solves this problem by using air only to scavenge the cylinder, but it requires an expensive high pressure system to inject fuel into the cylinder near the end of the compression stroke. The thermal ignition cycle described herein eliminates the fuel loss in a unique way by depositing the fuel in the ignition chamber with inexpensive low pressure fuel systems. In addition, the absence of an electrical ignition equipment should greatly encourage the development of efficient, inexpensive, and high speed engines operating with the two stroke cycle.

Dual fuel engines were developed mainly for large powerplants operating in localities where natural gas was available and inexpensive. This gas is difficult to ignite in engines due to the fuel's very high critical compression ratio of more than 12:1. The problem is solved by the high pressure injection of a very small quantity of a second fuel near the end of the compression cycle which ignites to create a small pilot flame to cause combustion of the large mass of gas. Gaseous fuels provide a longer life for the lubricants and the engine is internally cleaner.

In the present invention, a low pressure fuel system deliver a sufficient amount of the second fuel to the ignition chamber to provide a nearly ideal mixture with the air therein. After ignition occurs, the process of combustion proceeds and upon opening the transfer valve, this pilot flame discharges to ignite the gas fuel in the main combustion chamber. This method would make possible, the combustion of any substance that will burn, including many high energy fuels with poor combustion efficiencies. The combustion of a substance that is not considered a fuel would also be possible by depositing one substance in the ignition chamber and a second substance in the main combustion chamber. When the transfer valve opens, they combine to cause combustion by chemical reaction. It would be possible in this case to formulate chemicals that are non-combustible when apart but when mixed, provide energy to power safe, non-polluting, and quiet vehicles operating, e.g., within buildings.

Recently, considerable time and effort has been directed to the development of a coal burning internal combustion engine. A great deal of this effort focused on a diesel cycle fueled by a coal/water mixture in the form of a thick slurry. However, the inherent faults of the diesel cycle present many problems when utilizing an abrasive fuel such as powdered coal. The very high pressures required for fuel delivery cause excessive water of the injection system and injectors. In addition, the combustion process is slower and much of the coal remains unburned, which contributes to rapid wear of the piston rings and cylinder walls. Processing the powdered coal into a slurry also adds considerable cost to the fuel.

The present invention can also utilize slurries as well as dry particulate fuels and retain a relatively simplified form, with the additional advantage of being able to burn abrasive particulate fuel without undo cylinder or piston ring wear. This is accomplished by depositing the particulates in the ignition chamber with the heat added to the fuel as previously described and by adjusting the pressures and temperatures accordingly in the ignition chamber to condition the fuel to a putty-like state, or in some cases, liquefy or vaporize the fuel into a gas. The fuel, when discharged into the higher temperature air in the working chamber, would be completely consumed before reaching the cylinder walls. A low pressure system which delivers fuel to the ignition chamber would provide a considerably extended life for its components.

As will be apparent to those skilled in the art, various changes and modifications may be made to the illustrated thermal ignition method and apparatus for internal combustion engines of the present invention without departing from the spirit and scope of the invention as determined in the appended claims and their legal equivalent.

What is claimed is:

1. An apparatus for inducing thermal ignition in internal combustion engines having a working chamber that has at least a compression stroke pressurizing inlet air to effect a temperature rise thereof above the ignition temperature of the fuel, comprising:

an injector body connected to and in fluid communication with a working chamber of an internal combustion engine;

an ignition chamber within said injector body;

means for selectively introducing fuel into said ignition chamber;

transfer valve means for selectively interrupting and opening the fluid communications between the working chamber and said ignition chamber;

an air passage extending between the working chamber and said ignition chamber and having a valve therein to prevent air from flowing from said ignition chamber to the working chamber; and means for controlling said fuel introduction means to introduce fuel into the air in said ignition chamber to effect ignition thereof in said ignition chamber and for controlling said transfer valve means to open during the compression stroke to introduce the ignited fuel and air in said ignition chamber into the working chamber.

2. Apparatus according to claim 1, further comprising:

means for regulating the pressure in said air passage to regulate the pressure of the air supplied through said air passage from the working chamber to said ignition chamber to a pressure sufficiently high to cause a temperature rise thereof above the self-ignition temperature of the fuel.

3. Apparatus according to claim 2, wherein said controlling means includes a piston connected to said transfer valve means and responsive to pressure differentials on opposite sides thereof to open and close said transfer valve means.

4. Apparatus according to claim 1, wherein said valve in said air passage comprises a check valve.

5. Apparatus according to claim 3, wherein said valve in said air passage comprises a check valve and further comprising an additional check valve in said air passage between said pressure regulating means and the working chamber to prevent the flow of air from the working chamber in the direction of said pressure regulating means.

6. Apparatus according to claim 5, further comprising a sequence valve and a third check valve disposed in parallel paths and connecting to another passage that communicates with said piston.

7. Apparatus according to claim 1, further comprising a water injector for injecting water into the working cylinder.

8. Apparatus according to claim 7, further comprising means for controlling said water injector to inject water into the working cylinder during alternate cycles.

9. A method for inducing thermal ignition in internal combustion engines having a working chamber that operates through a cycle that includes a compression stroke that raises the temperature of the compressed air to a temperature above the ignition temperature of the fuel, comprising the steps of:

(a) passing an amount of pressurized air during the compression stroke of the engine from the working chamber to an ignition chamber;

(b) introducing fuel to the pressurized air in the ignition chamber;

(c) sealing the ignition chamber to prevent the air-fuel mixture from escaping from the ignition chamber once ignition begins in the ignition chamber;

(d) passing the partially ignited air-fuel mixture from the ignition chamber to the working chamber so that complete combustion can occur.

10. A method according to claim 9, further comprising the step of introducing water into the working chamber on alternate cycles thereof to remove heat therefrom.

* * * * *